United States Patent [19]

Walker

[11] Patent Number: 4,907,713

[45] Date of Patent: Mar. 13, 1990

[54] ELECTRONIC HOUSING MODULE

[75] Inventor: John S. Walker, Scottsdale, Ariz.

[73] Assignee: Motorola, Inc., Schaumburg, Ill.

[21] Appl. No.: 329,166

[22] Filed: Mar. 27, 1989

[51] Int. Cl.[4] ..... B65D 6/34

[52] U.S. Cl. ..... 220/76; 220/67; 220/DIG. 29

[58] Field of Search ..... 220/75, 76, 67, DIG. 29

[56] References Cited

U.S. PATENT DOCUMENTS

| | | | |
|---|---|---|---|
| 180,356 | 7/1876 | Marquet | 220/75 |
| 1,687,343 | 10/1928 | Madden | 220/75 |
| 2,065,480 | 12/1936 | Soper | 220/75 |
| 2,163,619 | 6/1939 | Murch | 220/75 |
| 2,354,921 | 8/1944 | McClary | 220/75 |
| 2,522,097 | 9/1950 | Cookson | 220/75 |
| 2,857,076 | 10/1958 | Tolbert, Jr. et al. | 220/75 |
| 2,920,682 | 1/1960 | Lindberg | 220/75 |
| 4,023,589 | 5/1977 | Rejeski | 220/75 |
| 4,700,863 | 10/1987 | Filippi et al. | 220/75 |

*Primary Examiner*—Joseph Man-Fu Moy
*Attorney, Agent, or Firm*—Jordan C. Powell

[57] ABSTRACT

A means and method of constructing electronic housing modules in sections and joining the sections together in modular fashion. A coupler for joining the sections of the module housing can be constructed in a variety of ways allowing the module to take on various housing configurations. For instance, the module can be constructed as a rectangular or triangular box using the coupler. The coupler is preferably comprised of a longitudinal member including at least one groove. Each groove comprises an upper and lower extending lip. To construct the housing module, the sections, or housing walls, of the module are inserted into the groove between the upper and lower lips. The lower lip acts as a support for the inserted housing wall. The upper lip includes a flared portion at the extending end of the upper lip. A ledge secured to and protruding from the bottom plane of the upper lip. The ledge is located close to the inner portion of the groove. The walls of the housing module are made of malleable or extrudable materials. When the housing wall is inserted into the groove of the coupler, the end of the extrudable housing member slips underneath the ledge and butts against the end of the groove. This insures proper alignment of the extrudable housing member with the coupler. The upper lip is then crimped down onto the inserted housing wall. The flare of the upper lip causes the material of the housing wall to flow into the cavity areas of the groove. By constructing the housing module in modular fashion, the housing can be made easily and inexpensively.

12 Claims, 1 Drawing Sheet

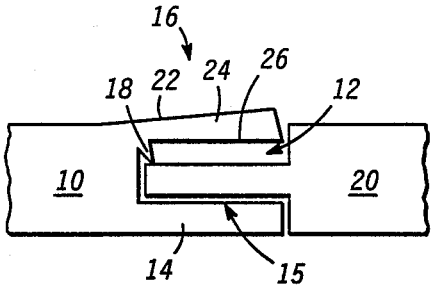
FIG. 1
FIG. 1A
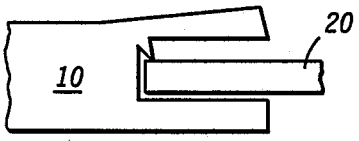
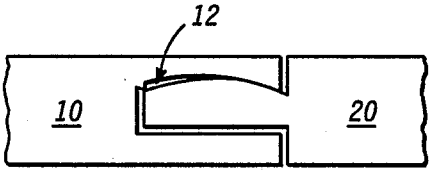
FIG. 2
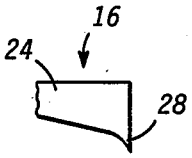
FIG. 3
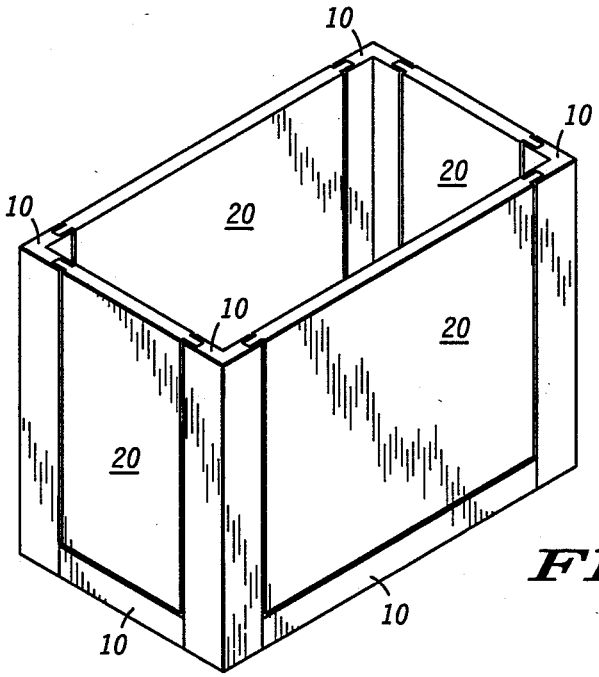
FIG. 4

ELECTRONIC HOUSING MODULE

BACKGROUND OF THE INVENTION

This invention relates, in general, to housing modules for electronics, and more specifically, to a method for constructing electronic housing modules, and apparatus for modular construction of the modules.

Under conventional construction techniques, for fabricating an electronic housing module is to be fabricated, an entire section of housing must be cast or extruded. If the die for the section of housing is particularly complicated or large, the die is very expensive. In fact, the cost of the die is proportional to the size and complexity of the section of housing. Furthermore, it is impracticable to construct large, extended housing members in a single cast or extrusion since the die cannot practically be made.

SUMMARY OF THE INVENTION

Accordingly, it is an object of the present invention to provide a method and apparatus for reducing the cost of dies used in constructing electronic housing modules.

Another object of the present invention is to provide a means of constructing electronic housing modules in modular fashion.

A futher object of the present invention is to provide a coupler for connecting sections of housing modules in modular fashion.

The above objects of the invention are achieved by constructing electronic housing modules in sections and joining the sections together in modular fashion. A coupler for joining the sections of the module housing can be constructed in a variety of ways allowing the module to take on various housing configurations. For instance, the module can be constructed as a rectangular or triangular box using the coupler. The coupler is preferably comprised of a longitudinal member including at least one groove. Each groove comprises an upper and lower extending lip. To construct the housing module, the sections, or housing walls, of the module are inserted into the groove between the upper and lower lips. The lower lip acts as a support for the inserted housing wall. The upper lip includes a flared portion at the extending end of the upper lip. A ledge secured to and protruding from the bottom plane of the upper lip. The ledge is located close to the inner portion of the groove. The walls of the housing module are made of malleable or extrudable materials. When the housing wall is inserted into the groove of the coupler, the end of the extrudable housing member slips underneath the ledge and butts against the end of the groove. This insures proper alignment of the extrudable housing member with the coupler. The upper lip is then crimped down onto the inserted housing wall. The flare of the upper lip causes the material of the housing wall to flow into the cavity areas of the groove. By constructing the housing module in modular fashion, the housing can be made easilly and inexpensively.

the above and other objects, features, and advantages of the present invention will be better understood from the following detailed description taken in conjunction with the accompanying drawings.

BRIEF DESCRIPTION OF THE DRAWING

FIG. 1 is a side view of a module housing wall coupler having a groove, and a malleable housing wall is inserted into the groove.

FIG. 1A is a side view of the housing wall coupler and malleable housing wall of FIG. 1 showing the malleable housing member in a second embodiment.

FIG. 2 is a side view of the housing wall coupler and malleable housing wall of FIG. 1 after the coupler has been secured to the housing wall.

FIG. 3 is a side view of an expanded member of the housing wall coupler of FIG. 1.

FIG. 4 is an isometric view of an rectangular electronic housing module constructed using the apparatus and techniques of the present invention.

DETAILED DESCRIPTION OF THE INVENTION

FIG. 1 shows a coupler 10 including, in its preferred embodiment, a groove 12. Groove 12 comprises a lower lip 14, an upper lip 16, and a ledge 18. A housing wall 20 is shown inserted into groove 12. Housing wall 20 may be comprised of extrudable material or other malleable wrought plates.

Lower lip 14 extends in a horizontal plane with respect to the inserted housing wall 20. Housing wall 20 rests upon upper edge 15 of lower lip 14.

Upper lip 16 is initially oriented in a slightly inclined position with respect to lower lip 14. This allows housing wall 20 to be inserted into groove 12. When housing wall 20 is inserted into groove 20, the inserted end of housing wall 20 is secured under ledge 18. Upper lip 16 is then crimped downward and onto housing member 20 until a top plane 22 of upper lip 16 is parallel with lower lip 14. A flare 24 of upper lip 16 is pushed into housing member 20. The extrudable material of housing member 20 flows out of its original state and up an inner incline 26 of flare 24. As the material of housing member 20 flows out of its original state, it substantially fill the voids of groove 12. This secures extrudable housing member 20 into groove 12.

Ledge 18 operates in conjunction with flare 24 to press the extrudable material of housing wall 20 into the cavities of groove 12. As upper lip 16 forces the extrudable material into groove 12, ledge 18 applies a reverse force on the extrudable material causing housing wall 20 to deform upwards, sideways, and backwards. Ledge 18 also holds housing wall 20 in its proper alignment with respect to lower lip 14. Ledge 18 may be deformable to allow minor welding or molding of ledge 18 to the malleable material of housing wall 20.

FIG. 1A shows housing wall 20 in a second embodiment as a simple plate.

FIG. 2 shows housing member 20 secured to coupler 10. The extruded material of housing member 20 is shown filling the cavities of groove 12.

Upper lip 16 may include a hook 28 at the end of flare 24, as shown in FIG. 3. Hook 28 helps secure housing wall 20 into groove 12. Hook 28 is preferably nondeformable. Hook 28 is embedded within housing wall 20 during the crimping process of upper lip 16.

Coupler 10 allows casting dies for electronic module housings to be substantially reduced in cost. Conventionally, when a module is to be cast, the entire section of housing must be cast in a single die. Since the cost of fabrication of the module is proportional to the size of the casting die, modules which are large or long are very expensive to construct. Furthermore, the length of a module constructed in a single cast is limited since the length of the die is practically limited. Coupler 10 allows various sections of a module to be constructed separately which otherwise would require casting in a single die. The members of the module can be cast in separate dies, many of which are replicated and cast in the same die. The cost of the separate, less complicated dies is less than that of a single large and complicated die. Coupler 10 may be extruded rather than cast to further reduce the cost of dies. The members of the module are represented in FIGS. 1 and 2 as housing wall 20. Thesemembers are comprised of malleable material to allow deformation when coupler 10 is crimped. The members of the module are then inserted into lengths of coupler 10. Upper lip 16 is then crimped onto housing wall 20 to join the members together in their modular configuration.

FIG. 4 shows a simple rectangular module constructed using housing walls 20 and couplers 10. Coupler 10 comprises, in this embodiment, a plurality of grooves 12 having centerlines oriented at right angles with each other. A rectangular, open-ended box, such as is shown in FIG. 4, can be constructed in a quick, easy, and inexpensive manner, and is easilly adapted to assembly line construction.

Although a rectangular box has been shown in FIG. 4 for illustrative purposes, virtually all shapes or configurations required for electronic housing can be constructed using the means provided in the present invention. Furthermore, coupler 10 of FIGS. 1 and 2 can be cast as part of any housing wall 20 yielding a tongue and groove effect of housing wall 20.

It will be recognized that the method and means of constructing housing modules as outlined above and in the appended claims is not limited to electronic housing modules. These methods and apparatus may extend to use with a variety of articles which must be housed within rigid modules.

Thus there has been provided, in accordance with the present invention, an electric housing module that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A housing module comprising:

a plurality of housing wall means, said housing wall means comprised of malleable material;

a plurality of coupling means for securing said plurality of housing wall means together, each of said plurality of coupling means including at least one groove means;

said coupling means crimped onto at least one each of said plurality of housing wall means when said plurality of housing wall means is inserted into said at least one groove means;

said plurality of housing wall means extruding into said at least one groove means when said plurality of coupling means is crimped onto said plurality of housing wall means; and said plurality of coupling means and said plurality of housing wall means forming a predetermined enclosure.

2. A housing module according to claim 1 wherein said at least one groove means comprises:

first and second lip means;

said first and second lip means extending laterally from said plurality of coupling means to outline said at least one groove means;

said first lip means for supporting said plurality of housing wall means when said plurality of housing wall means is inserted between said first and second lip means;

said second lip means initially extending at an incline from parallel with said first lip means;

said second lip means crimped onto said plurality of housing wall means; and said second lip means for securing said plurality of housing wall means within said at least one groove means when said second lip means is crimped onto said plurality of housing wall means.

3. A housing module according to claim 2 wherein said at least one groove means further comprises:

ledge means for securing said plurality of housing wall means into proper orientation with respect to said first lip means; and said ledge means secured to said second lip means near an innermost portion of said at least one groove means.

4. A housing module according to claim 2 wherein said second lip means comprises:

flare means for causing an extrusion of said plurality of housing wall means when said second lip means is crimped onto said plurality of housing wall means; and said flare means secured to an extending end of said second lip means.

5. A housing module according to claim 1 wherein said second lip means comprises:

hook means for penetrating into said plurality of housing wall means to secure said plurality of housing wall means to said plurality of coupling means when said second lip means is crimped onto said plurality of housing wall means; and said hook means secured to an extending bottom end of said second lip means.

6. A coupler for use in modular construction of housing modules comprising:

first and second lip means;

said first and second lip means extending laterally from the coupler;

said first lip means for supporting a malleable housing wall means of said housing modules when said housing wall means is inserted between said first and second lip means;

said second lip means initially extending at an incline from parallel with said first lip means;

said second lip means crimped onto said plurality of housing wall means;

said second lip means extruding said housing wall means between said first and second lip means; and said second lip means for securing said housing wall means to the coupler when said second lip means is crimped onto said housing wall means.

7. A housing module according to claim 6 wherein the coupler further comprises:

ledge means for securing said housing wall means into proper orientation with respect to said first lip means; and said ledge means secured to said second lip means near a point where said second lip means is secured to the coupler.

8. A housing module according to claim 6 wherein said second lip means comprises:

flare means for causing said extrusion of said housing wall means when said second lip means is crimped onto said housing wall means; and said flare means secured to an extending end of said second lip means.

9. A housing module according to claim 6 wherein said second lip means comprises:

hook means for penetrating into said housing wall means to secure said housing wall means to the coupler when said second lip means is crimped onto said housing wall means; and said hook means secured to an extending end of said second lip means.

10. A method of modularly constructing an electronic housing module comprising:

forming at least one housing wall comprised of malleable material;

forming at least one coupler including a lower lip, said at least one coupler further including an upper lip oriented at an incline with respect to said lower lip;

inserting one each of said at least one housing wall into one each of said at least one coupler between said lower lip and said upper lip; and crimping said upper lip onto said at least one housing wall to cause said the malleable material of said at least one housing wall to extrude into the voids between said upper lip and said lower lip.

11. A method of modularly constructing an electronic housing module according to claim 10 wherein said step of forming at least one housing wall comprised of malleable material comprises extruding said at least one hosing wall comprised of malleable material.

12. A method of modularly constructing an electronic housing module according to claim 10 wherein said step of forming at least one housing wall comprised of malleable material comprises casting said at least one hosing wall comprised of malleable material.

* * * * *

UNITED STATES PATENT AND TRADEMARK OFFICE

CERTIFICATE OF CORRECTION

PATENT NO. : 4,907,713

DATED : March 13, 1990

INVENTOR(S) : John S. Walker

It is certified that error appears in the above-identified patent and that said Letters Patent is hereby corrected as shown below:

In column 6, claim 12, line 23, delete the word "hosing" and substitute --housing--.

In column 6, claim 11, line 5, delete the word "hosing" and substitute --housing--.

Signed and Sealed this

Tenth Day of September, 1991

*Attest:*

HARRY F. MANBECK, JR.

*Attesting Officer*

*Commissioner of Patents and Trademarks*